US005375583A

United States Patent [19]

Meyer et al.

[11] Patent Number: 5,375,583

[45] Date of Patent: Dec. 27, 1994

[54] ADAPTIVE CLOSED-LOOP ELECTRONIC FUEL CONTROL SYSTEM WITH FUEL PUDDLING COMPENSATION

[75] Inventors: Garth M. Meyer, Dearborn; Rogelio G. Samson, Bloomfield Hills; Ronald L. Martelli, Bloomfield, all of Mich.

[73] Assignee: Ford Motor Company, Dearborn, Mich.

[21] Appl. No.: 990,382

[22] Filed: Dec. 14, 1992

[51] Int. Cl.[5] ..... F02D 41/14

[52] U.S. Cl. ..... 123/681; 123/687; 123/696

[58] Field of Search ..... 123/674, 675, 679–686, 123/687, 689, 696

[56] References Cited

U.S. PATENT DOCUMENTS 4,357,923 11/1982 Hideg ..... 123/492
4,461,258 7/1984 Becker et al. ..... 123/681

FOREIGN PATENT DOCUMENTS 3-164545 7/1991 Japan ..... 123/681

OTHER PUBLICATIONS

SAE Technical Paper Series *A Closed-Loop A/F Control Model for Internal Combustion Engines,* Hamburg et al, Jun., 1980.

SAE Technical Paper Series *Fuel Injection ControlSystems that Improve Three Way Catalyst Conversion Efficiency,* Katashiba et al, Feb., 1991.

*Primary Examiner*—Andrew M. Dolinar

*Attorney, Agent, or Firm*—Allan J. Lippa; Roger L. May

[57] ABSTRACT

An air/fuel mixture control system for an internal combustion engine uses a closed-loop controller which varies the air/fuel mixture in response to the oxygen level in the engine's exhaust emissions to achieve stoichiometry. The oxygen level sensor produces a binary signal indicating either a rich or a lean mixture. The controller responds by generating a fuel delivery rate control signal which has three components: an integral (ramp function) component, a proportional step function component which abruptly jumps the control signal to an intermediate level at the time of each oxygen level change, and a differential overshoot component which (1) injects a compensating volume of fuel into the engine intake at the onset of each lean signal, and (2) subtracts a compensating volume of fuel from the intake at the onset of each rich signal. The compensating fuel volume minimizes the effects of fuel puddling in the intake manifold to reduce the effective closed loop delay time for better control. The magnitude of the compensating volume may be altered in response to detected engine speed and/or load, or alternatively may be adaptively varied to achieve maximum closed loop cycling frequencies.

7 Claims, 3 Drawing Sheets

ADAPTIVE CLOSED-LOOP ELECTRONIC FUEL CONTROL SYSTEM WITH FUEL PUDDLING COMPENSATION

FIELD OF THE INVENTION

This invention relates to methods and apparatus for automatically controlling the air/fuel ratio of the fuel mixture delivered to an internal combustion engine.

BACKGROUND OF THE INVENTION

Electronic fuel control systems are increasingly being used in internal combustion engines to precisely meter the amount of fuel required for varying engine requirements. Such systems vary the amount of fuel delivered for combustion in response to multiple system inputs including throttle angle and the concentration of oxygen in the exhaust gas produced by combustion of air and fuel.

Electronic fuel control systems operate primarily to maintain the ratio of air and fuel at or near stoichiometry. Electronic fuel control systems operate in a variety of modes depending on engine conditions, such as starting, rapid acceleration, sudden deceleration, and idle. One mode of operation is known as closed-loop control. Under closed-loop control, the amount of fuel delivered is determined primarily by measuring the concentration of oxygen in the exhaust gas to determine the extent to which the ratio of air to fuel (A/F) in the ignited mixture deviates from stoichiometry.

The oxygen in the exhaust gas is typically sensed by a heated exhaust gas oxygen (HEGO) sensor. The electronic fuel control system adjusts the amount of fuel being delivered in response to the output of the HEGO sensor when the sensor output indicates a rich air/fuel ratio, below stoichiometry the control system decreases the amount of fuel delivered while the detection of a lean air/fuel ratio increases the fuel flow.

The effective operation of closed-loop fuel control systems using exhaust gas sensors is complicated by the physical transport delay experienced by a given mass of fuel and air as it travels from the intake manifold through the engine and exhaust system to the HEGO sensor. This transport delay prevents the system from promptly detecting and responding to undesirable air/fuel ratios, resulting in reduced catalyst conversion efficiencies and an increase in HC, CO and NOx emissions.

SUMMARY OF THE INVENTION

In accordance with a principal feature of the invention, whenever the HEGO sensor generates an indication that engine combustion has switched from lean to rich A/F, the level of fuel being delivered to the engine's intake is abruptly changed in a compensating direction to an overshoot level, then returned to an intermediate level, and then gradually adjusted in the compensating direction until the sensor generates an indication that A/F has switched from rich to lean.

As contemplated by the invention, this abrupt overshoot in the amount of delivered fuel compensates for the effect of "fuel puddling" on the interior walls of the engine's intake system. For example, when a transition from a lean to a rich A/F is detected by the HEGO sensor, the control system contemplated by the invention responds by abruptly and momentarily reducing the amount of fuel delivered to a lower level. This abrupt reduction compensates for the portion of fuel from the fuel puddle, collected on the intake walls, which enters the combustion chamber. The accumulated fuel is thereby prevented from deleteriously delaying the effect of the correction in the air/fuel ratio. Similarly, when a transition from a rich to lean mixture is detected, the control system contemplated by the invention produces a momentary and abrupt increase in the fuel delivery rate to compensate for the re-depositing of fuel on the intake walls.

In accordance with the invention, a control signal is generated in response to detected deviations from stoichiometry which immediately adds or subtracts a compensating volume of fuel from the fuel stream being delivered to the engine, the magnitude of this compensating volume being varied in response to existing engine operating conditions.

In the arrangement to be described, the volume of compensating fuel added and subtracted during each control cycle is varied to optimize performance by storing control values in a lookup table indexed by engine speed and load. These control values are then retrieved from the table in accordance with current engine speed and load to determine the magnitude of the compensating fuel volume added or subtracted from the intake fuel stream at the time each shift in A/F from stoichiometry is indicated by the exhaust sensor.

In an alternative arrangement, the compensating volume may be adaptively determined by measuring the effective HEGO frequency of oscillation and injecting a compensating volume of fuel which maximizes that frequency (and which hence minimizes the effective control loop delay of the fuel control system). In this way, the amount of compensating fuel volume injected during the enhanced jumpback phase as contemplated by the invention accounts for different fuel puddling due to deposits, engine wear, or variations in assembly by effectively reducing the system transport delay through the cylinders and the exhaust manifold.

The enhanced jumpback control system contemplated by the invention improves the dynamic response and static performance of the engine by improving the air/fuel mixture control during transients such as acceleration or deceleration, resulting in a more responsive system with improved catalytic conversion efficiency and decreased tail-pipe emissions.

An advantage, especially of certain preferred embodiments of the invention, is to significantly reduce the effective transport delay of a closed-loop fuel control system. More generally, such advantage in the improvement is dynamic response and static performance of an internal combustion engine to obtain higher catalytic conversion efficiencies, and lower tailpipe exhaust emissions. These and other features and advantages of the present invention will become more apparent through a consideration of the following detailed description of a preferred embodiment of the invention.

DETAILED DESCRIPTION

Figure 1:
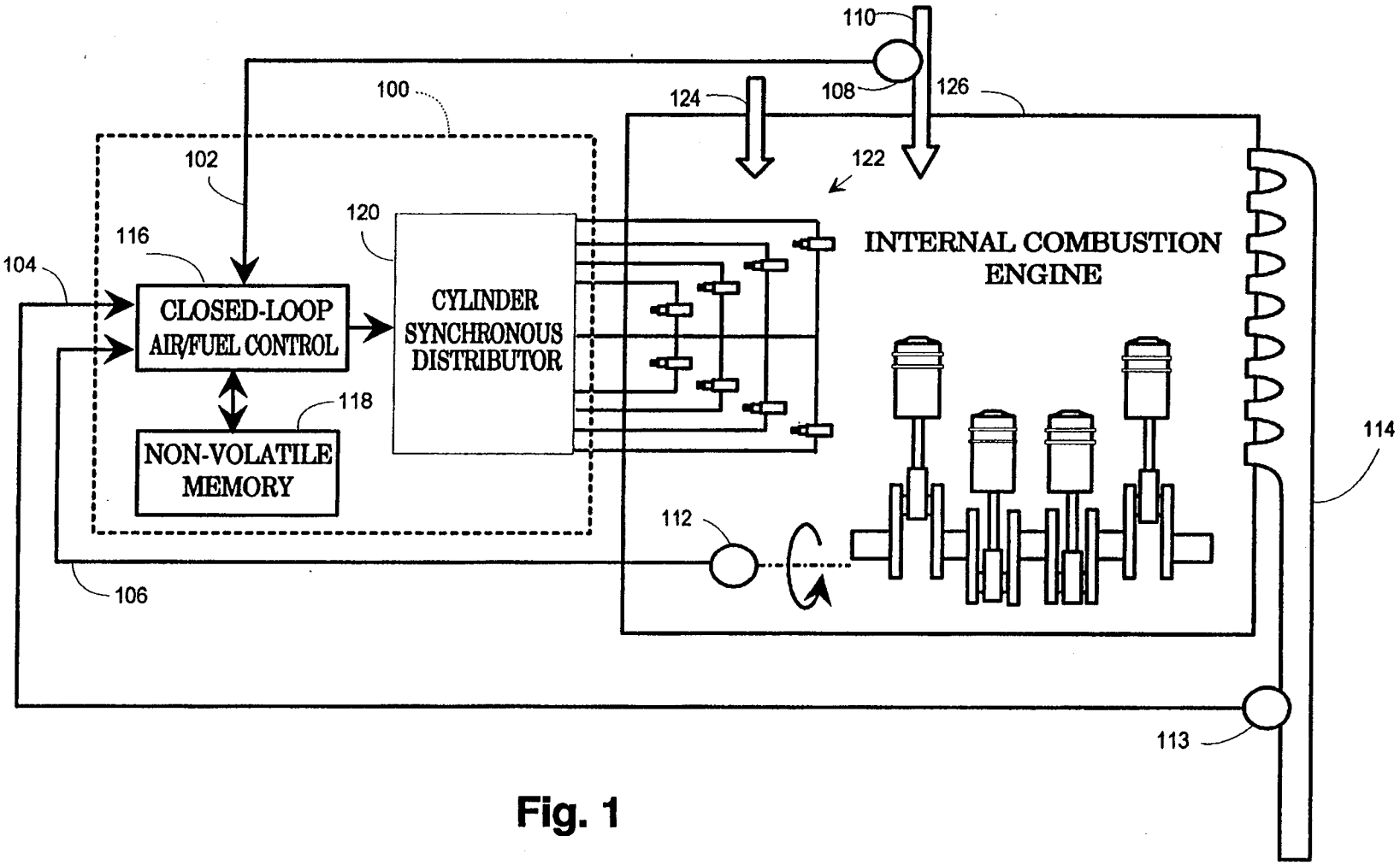
FIG. 1 is a schematic block diagram of an internal combustion engine and an electronic engine control system which embodies the invention.

FIG. 1 of the drawings shows a system which embodies the principles of the invention. A proportional+integral+differential (PID) controller 100 has three signal inputs 102, 104, and 106. Signal input 102 is produced by a mass air flow sensor 108 which generates a voltage proportional to the mass of air being delivered to the engine through an air intake manifold 110. Signal 106 is obtained from a transducer 112 which generates a series of timing impulses as the crankshaft turns. These timing pulses may be processed as discussed below to provide an indication of crankshaft and piston positions, as well as the engine's rotational velocity (rpm). Input signal 104 is produced by the exhaust gas oxygen sensor (HEGO) 113 which generates a voltage that is a function of the concentration of oxygen or A/F in the exhaust manifold 114. This voltage is used as an input to a voltage comparator (not shown) to detect whether the exhaust air fuel ratio is rich or lean of stoichiometry.

The PID controller 100 consists of three modules: a closed-loop air/fuel control system 116; a nonvolatile memory 118; and a cylinder synchronous signal distributor 120. These modules, all of which are preferably implemented by a microcontroller operating under stored program control, produce control signals which are applied to actuate the fuel injectors indicated generally at 122 in FIG. 1. Each of the fuel injectors 122 is operatively connected to a fuel supply conduit indicated at 124 and physically integrated with an internal combustion engine depicted within the dotted rectangle 126. Each of the fuel injectors 122 is of conventional design and is positioned to inject fuel into its associated cylinder in precise quantities at precise times synchronized with engine motion by the impulses from transducer 112. These impulses which may be applied as interrupt signals, called PIPS (Piston Interrupt Signals), which are typically applied to the microprocessor's interrupt terminal (not shown). The microprocessor then responds by executing interrupt handling routines which perform time-critical operations under the control of variables stored in memory.

In accordance with a principal feature of the invention, each time the exhaust sensor 113 detects combustion products resulting from a switch from rich to lean A/F, the injector fuel delivery at the engine intake is first abruptly increased to an overshoot level, then reduced to a first intermediate level, and thereafter again gradually increased until the exhaust sensor detects combustion products resulting from a switch from lean to rich A/F, at which time the injector fuel delivery is abruptly decreased to an undershoot level, then returned to a second intermediate level, and thereafter gradually decreased until the exhaust sensor again detects combustion products resulting from a switch from rich to lean A/F.

This novel method of controlling the fuel flow from the fuel injectors, here termed the "enhanced jumpback" method, more accurately confines the air/fuel ratio near stoichiometry, during transient operation, than prior methods. The three graphs of FIG. 2 illustrate and compare the performance of the enhanced jumpback method and two prior methods of closed loop air/fuel control.

Figure 2A:
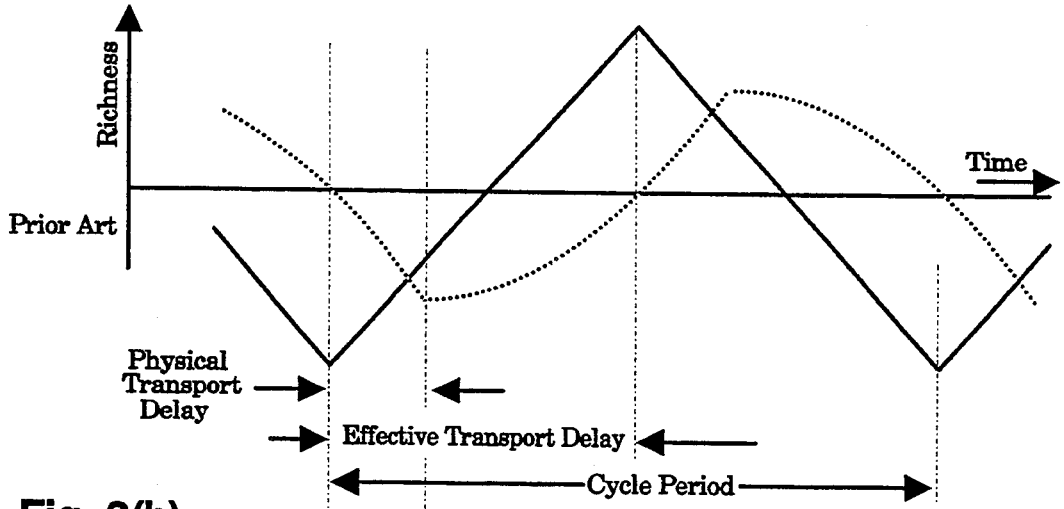
FIG. 2(*a* through *c*) are graphs comparing the operation of the present invention, seen in 2(*c*), with two prior art control methods seen in 2(*a*) and 2(*b*).
Figure 2B:
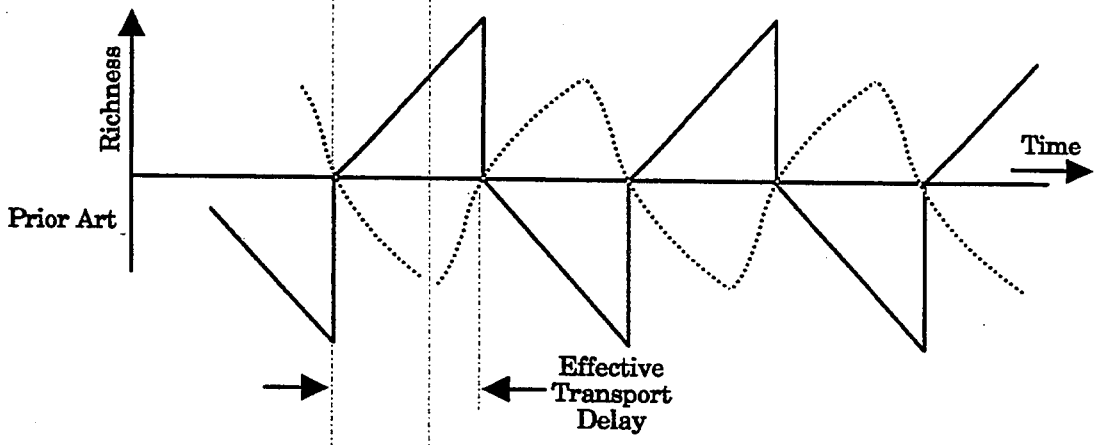
Figure 2C:
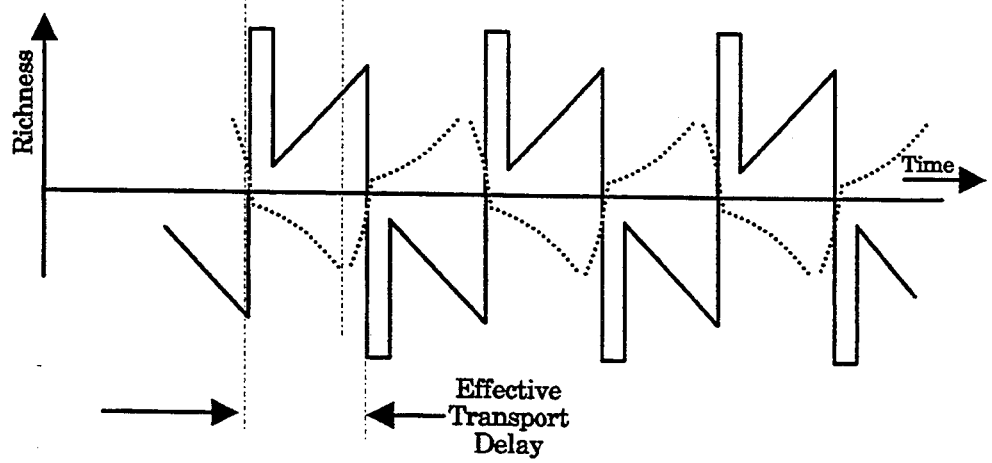

The first prior art control method is illustrated on line (a) of FIG. 2 which shows waveshapes created by an air/fuel control system using a simple integrator as a controller as described by Zechnall, et al. in SAE Paper No. 730566. The solid, sawtooth waveshape in line (a) illustrates the fuel-rate signal applied to the fuel injectors in response to the A/F of the combustion products as detected and measured by an exhaust sensor. The dashed line in FIG. 2(*a*) illustrates the variation in exhaust gas A/F at the sensor. Both the fuel flow rate, indicated by the solid line, and the exhaust A/F, indicated by the dashed line, are plotted such that increasing richness (decreasing air/fuel ratio) is represented by the positive-going increases on the graph.

The control system illustrated in line (a) of FIG. 2 increases the amount of fuel injected at a constant rate (slope) whenever the exhaust oxygen sensor detects A/F greater than stoichiometry, and decreases the amount of fuel injected as a similar constant rate whenever the exhaust gas sensor indicates that the exhaust A/F is less than stoichiometry. This form of control may be implemented by an exhaust gas sensor which operates as a simple switch, delivering either a positive or negative input signal to a simple integrator, depending on whether the exhaust gases are rich or lean. The integrator in turn delivers the sawtooth waveshape to control the air/fuel mixture supplied by the engine's intake system.

As seen in line (a) of FIG. 2, the peaks of the dashed-line waveshape illustrating exhaust A/F are delayed from the corresponding peaks of the solid-line fuel-intake waveshape. This peak-to-peak delay results from the physical transport delay experienced by the air and fuel as it passes through the engine's intake manifold, undergoes combustion in the cylinders, and passes partially through the exhaust system to the position of the sensor. Thus, at time $t_0$, when the exhaust sensor detects a transition from a rich A/F to a lean A/F, the previously decreasing fuel flow rate is switched to a gradually increasing rate. This reversal of the rate of change of the intake mixture is not manifested at the exhaust sensor until time $t_1$, which is delayed from time $t_0$ by the physical transport delay experienced by the combustion products in passing through the engine and the exhaust system.

The control system illustrated in line (a) of FIG. 2 causes the air/fuel ratio to "hunt" about stoichiometry, and the period of each cycle is delayed considerably beyond the duration of the physical transport delay. Note that, beginning at time $t_0$ when the effects of the increasing fuel rate are detectable at the sensor, the combustion products seen at the sensor continue to indicate a lean condition until time $t_2$ when the exhaust oxygen level again indicates a rich rather than lean condition. As seen in line (a), by the time $t_2$ when the fuel flow rate is switched to a decreasing slope, the intake mixture has grown excessively rich. With the transport delays observed in the control system illustrated in line (a), the fuel flow rate (integrator rate) has to be decreased to limit the maxim peak to peak amplitude of A/F oscillation. However, during transients, this integrator rate limits the dynamic response of the A/F control.

A method for improving the performance of such closed-loop air/fuel controls is illustrated in line (b) of FIG. 2 and was described by D. R. Hamburg and M. A. Schulman in SAE Paper 800826. The controller output signal is formed from the sum of an integral, sawtooth component and a term directly proportional to the two-level sensor output signal, forming the waveshape illustrated by the solid curve in line (b). Each time the exhaust sensor determines that the combustion products indicate A/F has passed through stoichiometry, the fuel injectors are accordingly commanded to immediately "jump back" to a nominal level (established by prior cycles) at or near stoichiometry. Thereafter, the flow rate is gradually altered in a direction opposite to its prior direction of change until the exhaust gas sensor determines that stoichiometry has again been reached. As seen in line (b), the physical transport delay from the intake air/fuel mixture peaks to the corresponding exhaust A/F peaks is unchanged from the physical delay seen in line (a), but the effective closed-loop delay, or limit cycle period, is dramatically decreased, allowing the system to hunt more rapidly. As a result the fuel flow rate (integrator rate) has to be increased to maintain the same peak to peak amplitude as shown in line (a).

In accordance with the principles of the present invention, an even greater improvement can be attained by providing an "enhanced jumpback" to even further reduce cycle period and increase the integrator rate. The improved performance of this method results in part from its ability to compensate for a physical phenomenon known as "puddling" which occurs in the engine fuel intake system. During that part of each closed-loop cycle when the fuel rate exceeds the stoichiometric level, excess fuel accumulates on the walls of the intake passageways. As a result, when an attempt is made to "jump back" to stoichiometry, the cylinders in fact continue to receive an excess of fuel as previously deposited fuel is again drawn from the intake walls by the now leaner mixture.

The same effect occurs when an attempt is made to jump back to stoichiometry from an excessively lean condition. The fuel in the newly rich mixture is deposited on the intake walls until equilibrium is again reached, so that the cylinders continue to receive an excessively lean mixture for a time.

The fuel puddling effect accordingly introduces an additional feedback loop delay period during which the air/fuel mixture is permitted to deviate even further from stoichiometry. The puddling effect in practice creates an effective transport delay which is approximately twice that which would be expected from the physical flow alone at a given engine speed.

As seen in line (c) of FIG. 2, the method of control contemplated by the present invention momentarily injects an excess of fuel into the intake mixture whenever a rich to lean transition is detected by the exhaust sensor, and momentarily places the fuel injectors in an excessively lean condition each time the exhaust sensor detects a lean to rich transition. The enhanced jumpback followed by a return to a flow level near stoichiometry significantly reduces not only the effective closed-loop delay but also reduces the extent to which the air/fuel mixture departs from stoichiometry during each cycle.

With a reduction in the effective control cycle period, the limit cycle frequency increases. For the same A/F peak-to-peak amplitude, the fuel flow rate (integrator rate) has to be increased. Thus, the air fuel control will be more responsive to disturbance produced by emission control devices such as positive crankcase ventilation system (PCV) value fuel canisters, and fuel vapor recovery systems. The result is a further increase in the catalyst conversion efficiency.

Figure 4:
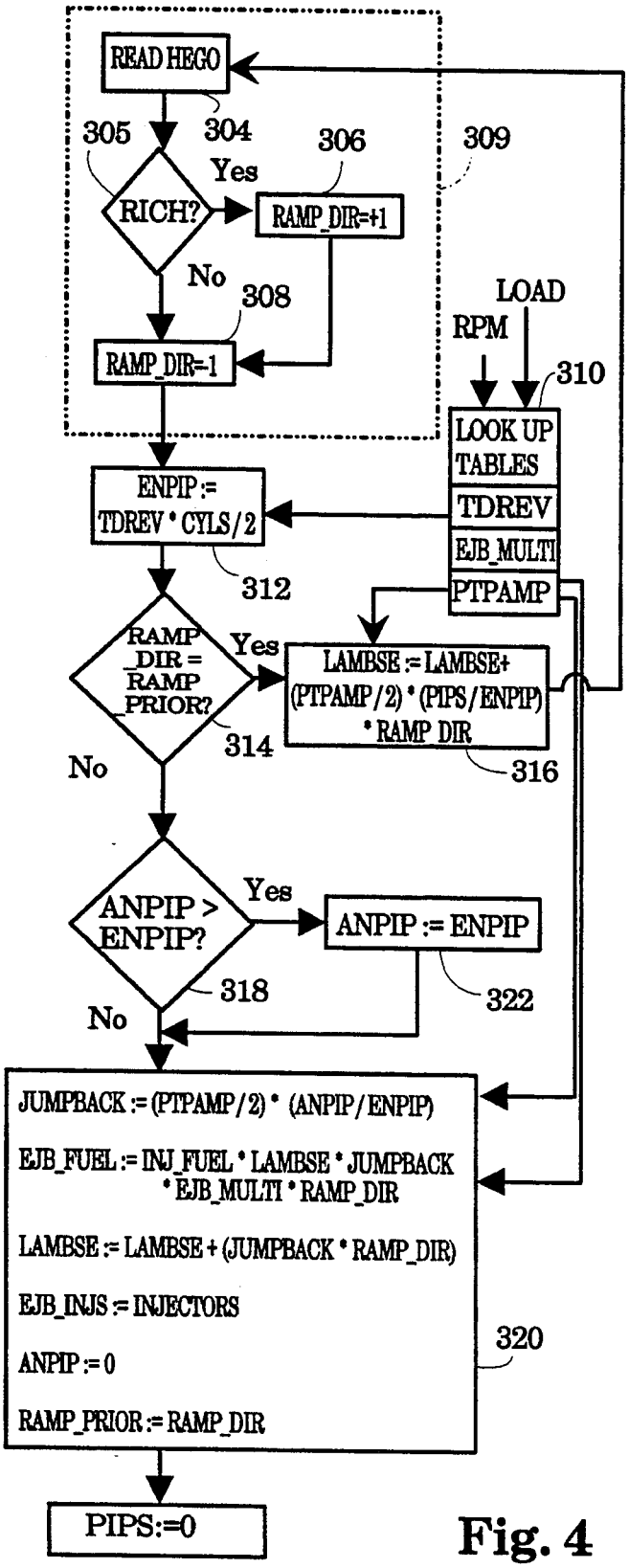
FIGS. 3, 4 and 5 are flowcharts of the operation of the preferred embodiment of the invention.
Figure 3:
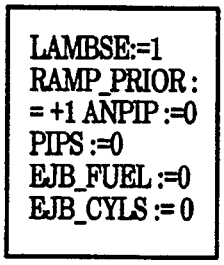
Figure 5:
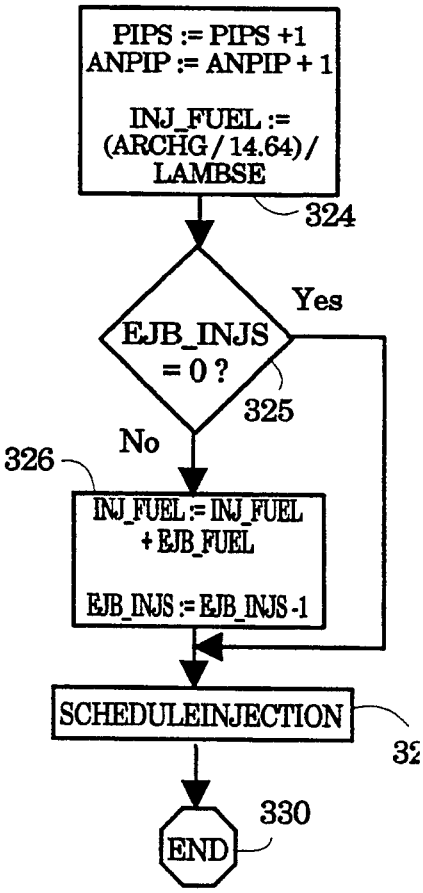

The closed loop air/fuel ratio control system 100, as noted earlier, is preferably implemented by a microcontroller. FIGS. 3, 4 and 5 illustrate the details of the preferred method of controlling the amount of fuel delivered by the fuel injectors seen at 122 by means of a closed-loop control implemented with a microcontroller operating under stored program control.

The closed loop control system first initializes several process variables as indicated in FIG. 3. The air/fuel control variable LAMBSE is set to a nominal value of 1.0. As discussed below, LAMBSE is cyclically altered by the closed loop control to vary the air/fuel ratio above and below stoichiometry. When initialized to 1.0, LAMBSE indicates a desired air/fuel ratio of 14.64. In addition, during initialization, the following variables are set: RAMP_PRIOR, which normally indicates whether the previous oxygen level sensed was rich or lean, is initialized at +1. ANPIP, a variable which holds the count of actual piston position interrupts issued since the last HEGO crossover, is initialized to zero. PIPS, a counter holding the number of piston position interrupts since the last loop was completed, is also set to zero. EJB_FUEL, a variable indicating the amount of compensating fuel to be added or subtracted during the enhanced jumpback, is set to zero. Finally, EJB_INJS, a counter which indicates the number of remaining compensating injections, is initialized at zero.

After initialization, the closed loop fuel control algorithm is repetitively executed in a continuous loop as illustrated in FIG. 4. As noted earlier, the concentration of oxygen in the exhaust gas is detected by the hot exhaust gas oxygen (HEGO) sensor 113, which may be the zirconia oxide ($ZrO_2$) type well known in the art. The HEGO sensor 113 generates a voltage that is a function of the concentration of oxygen in the exhaust manifold 114 which may advantageously converted into a digital quantity by an analog-to-digital converter within the microcontroller used to implement the control. The resulting digital quantity read from the sensor 113 and converted into digital form is placed in the variable HEGO as indicated in FIG. 4 at 304. The HEGO value is compared at 305 with a predetermined stored value indicating the voltage level which, for the particular HEGO sensor used, represents the sensor voltage output level at stoichiometry. If the HEGO voltage is greater than this stored value, indicating a rich mixture, the variable RAMP_DIR is set to +1 at 306, otherwise RAMP_DIR is set to −1 at 308. Accordingly, the sensing and comparison operation indicated within the dashed rectangle 309 produces a binary output RAMP_DIR which at either +1 or −1, depending on whether an oxygen level above or below stoichiometry is detected by the HEGO sensor.

The time base for controller actions is established by piston position interrupt signals obtained from the tachometer 112 which provides a sequence of interrupt signals which are supplied to the microcontroller, causing a hardware-forced branch to the interrupt handling routine which is depicted in FIG. 5 and discussed below. The closed loop routine seen in FIG. 4 performs a calculation, indicated at 312, of the process variable ENPIP, which represents the number of piston position interrupts which are expected to occur before the detection of stoichiometry crossover by the HEGO sensor. ENPIP is calculated by fetching the value TDREV from a lookup table 310 which stores transport delay values indexed by engine RPM and load (the index values being derived from the signals obtained from tachometer 112 and mass air flow sensor 108 seen in FIG. 1). The value TDREV from the lookup table is multiplied by (CYLS/2) to obtain the expected interrupt count ENPIP.

Next, at 314, RAMP_DIR is compared with PRIOR_RAMP to determine if the HEGO value has crossed over stoichiometry since the last reading. If no crossover occurred, LAMBSE is calculated as indicated at 316 by adjusting its prior value by an incremental amount equal (PTPAMP/2)*(PIPS/ENPIP)*RAMP_DIR, where PTPAMP is the desired peak to peak amplitude of A/F about stoichiometry. The value PTPAMP used in this adjustment to LAMBSE is obtained from an array of PTPAMP values stored in the lookup table 310 which is indexed by RPM and load values. The value (PIPS/ENPIP) specifies the fractional part of total transition during which the prior PIPS interrupts were issued. A return is then made to 304 for the next HEGO value.

If the test at 314 indicates that RAMP_DIR has changed sign, a number of calculations take place to produce the enhanced jumpback effect contemplated by the present invention. First, at 318, ANPIP (the actual number of piston position interrupts encountered during the most recent HEGO transition) is compared with the expected number ENPIP and, if larger, ANPIP is replaced by ENPIP at 322.

The value JUMPBACK is then set to PTPAMP/2 (or less if ANPIP is less than ENPIP) by the calculation:

JUMPBACK:=(PTPAMP/2)*(ANPIP/ENPIP)

where, as before, PTPAMP is a value obtained from the lookup table 310 which stores an array of predetermined PTPAMP values representing a predetermined function of engine RPM and engine load.

Next, EJB_FUEL, the volume of puddle compensating fuel to be added (or subtracted) from the fuel stream, is calculated by the expression:

EJB_FUEL=INJ_FUEL*LAMBSE*JUMPBACK*EJB_MULTI*RAMP_DIR where INJ_FUEL is the amount of fuel calculated for the last injection, and EJB_MULTI is a multiplier which, in the embodiment disclosed, is obtained from lookup table 310 which stores an array of EJB_MULTI values indexed by engine speed and load.

The table values for the enhanced jumpback multiplier EJB_MULTI variable indexed by engine speed and load are advantageously derived by varying the amount of jumpback over a predetermined range during steady state engine operation and by simultaneously monitoring the HEGO frequency and the catalyst conversion efficiency. The EJB_MULTI variable which generates the HEGO frequency that yields the highest catalyst conversion efficiency is stored in the lookup table 310 (implemented using the nonvolatile memory 118 seen in FIG. 1).

Because of variations during vehicle assembly and variations during the vehicle's service, the value EJB_MULTI may alternatively be automatically varied while monitoring the consequent transport delay (as indicated by ANPIP) to determine the value of EJB_MULTI which yields the best results. Similarly, the values PTPAMP and TDREV, which in the disclosed embodiment are obtained from the lookup table 310 which stores values based on the nominal performance of a particular vehicle, may also be adaptively adjusted to obtain the best catalyst conversion efficiency at the maximum HEGO frequency.

In addition to the calculation of JUMPBACK and EJB_FUEL, a new value of LAMBSE is calculated at 320 using:

LAMBSE:=LAMBSE+(JUMPBACK*RAMP_DIR)

which provides the unenhanced jumpback. As will be seen, the enhanced jumpback is added in the PIP interrupt handling routine shown in FIG. 5.

Also, at 320, the value EJB_INJS is set to the value INJECTORS (the total number of injections which are to receive a fuel command modified by the addition of EJB_FUEL. At the same time, ANPIP is reset to zero and RAMP_PRIOR is set to RAMP_DIR. Finally, PIPS is reset to zero and a return is made to 304 for the acceptance of a new HEGO reading.

The cylinder synchronous fuel control signal distributor 120 seen in FIG. 1 determines INJ_FUEL, the control signal to which each injector responds, and then schedules the fuel for the next injection. The actual fuel injection occurs in response to a PIP interrupt signal derived from the tachometer 112, which causes a hardware-forced branch to the interrupt handling routine seen in FIG. 5.

As seen at 324, the PIP interrupt handling routine begins by incrementing the PIP and ANPIP counts and by calculating:

INJ_FUEL:=(ARCHG/14.64)/LAMBSE where ARCHG is the air charge per stroke calculated from the mass air flow sensor at sensor 108 and LAMBSE is the value calculated in the closed loop control at 316 or 320.

A test is then performed at 325 to determine if EJB_INJS, the count of compensated (enhanced jumpback) injections has been decremented to zero. If not, the quantity EJB_FUEL calculated at 320 is added to INJ_FUEL to modify the amount of injected fuel to the enhanced jumpback level. The actual injection is then scheduled at 328 and the PIP interrupt handling routine terminates.

It is to be understood that the specific mechanisms and techniques which have been described are merely illustrative of one application of the principles of the invention. Numerous modifications may be made to the methods and apparatus described without departing from the true spirit and scope of the invention.

What is claimed is:

1. The method of controlling the air/fuel ratio of the combustion mixture supplied to the intake of an internal combustion engine which comprises, in combination, the steps of:

monitoring the level of oxygen in the combustion products exhausted by said engine to produce a control signal whenever said level increases beyond a predetermined threshold level, momentarily injecting a compensating volume of additional fuel into the intake of said internal combustion engine in response to said control signal, monitoring the level of oxygen in the combustion products exhausted by said engine to produce a second control signal whenever said level decreases below said predetermined threshold level, momentarily decreasing the amount of fuel injected into said intake in response to said second control signal, measuring the rotational speed of said engine, varying the magnitude of said compensating volume in response to changes in said rotational speed, and measuring the time duration between different ones of said control signals and varying the magnitude of said compensating volume to minimize said time duration.

2. The method of controlling the air/fuel ratio set forth in claim 1 further comprising, in combination, the steps of:

measuring the mass of air flow into said intake to provide an indication of engine load, and varying the magnitude of said compensating volume in response to changes in said indication of engine load.

3. The method of controlling the air/fuel ratio set forth in claim 1 further comprising, in combination, storing a plurality of control values in an addressable lookup table indexed by engine speed and load, measuring the mass of air flowing into said intake to develop a load signal, retrieving one of said control values from said lookup table in joint response to said rotational speed of said engine and said load signal, and adjusting the magnitude of said compensating volume in accordance with the retrieved one of said control values.

4. The method of controlling the fuel delivery rate at which fuel is supplied to the fuel intake of an internal combustion engine comprising, in combination, measuring the amount of oxygen in the combustion gases exhausted by said engine to produce a rich indication when said oxygen level is low and a lean indication when said oxygen level is high;

responding to each rich to lean indication by momentarily increasing said fuel delivery rate to an elevated overshoot level, then reducing said fuel delivery rate to a first intermediate level, and then gradually increasing said fuel delivery rate until said rich indication is produced;

responding to each lean to rich indication by momentarily decreasing said fuel delivery rate to a reduced undershoot level, then increasing said fuel delivery rate to a second intermediate level, and then gradually decreasing said fuel delivery rate until said lean indication is produced; and measuring the rotational speed of said engine and altering said overshoot level and said undershoot level in response to variations in said rotational speed, and measuring the time duration of one or more of said oxygen level indications and varying said undershoot level and said overshoot level to minimize said time durations.

5. The method of controlling the fuel delivery rate set forth in claim 4 further comprising, in combination, the steps of:

measuring the air flow rate into said intake of said engine and altering said overshoot level and said undershoot level in joint response to variations in either said air flow rate or said rotational speed.

6. The method of controlling the air/fuel ratio of the fuel mixture delivered to the intake of an internal combustion engine comprising, in combination, the steps of:

sensing the oxygen content of the exhaust gases resulting from the combustion of said fuel mixture in said engine to determine whether said content is above or below a predetermined desired level, gradually increasing said air/fuel ratio when said oxygen content is below said level, gradually decreasing said air/fuel ratio when said oxygen content is above said level, abruptly and momentarily increasing said air/fuel ratio to an overshoot value when said oxygen content decreases to traverse said predetermined level, abruptly and momentarily decreasing said air/fuel ratio to an undershoot level when said oxygen content increases to traverse said level, measuring the time duration when said oxygen content is above said level and when said oxygen content is below said level, measuring the rotational speed of the engine, and varying the magnitude of said overshoot and undershoot values in response to said time duration and to changes in said rotational speed.

7. The method of claim 6 further including the step of varying the magnitude of said overshoot and undershoot values in response to changes in the dynamic load on said engine.

* * * * *